United States Patent [19]

Choma

[11] Patent Number: 4,693,226

[45] Date of Patent: Sep. 15, 1987

[54] EGR CONTROL SYSTEM

[75] Inventor: Michael A. Choma, Dearborn Hts., Mich.

[73] Assignee: Ford Motor Company, Dearborn, Mich.

[21] Appl. No.: 869,481

[22] Filed: Jun. 2, 1986

[51] Int. Cl.[4] ..... F02M 25/06

[52] U.S. Cl. ..... 123/568

[58] Field of Search ..... 123/52 M, 52 MV, 568, 123/569

[56] References Cited

U.S. PATENT DOCUMENTS

| | | | |
|---|---|---|---|
| 2,114,548 | 4/1938 | Stadlman | 123/568 X |
| 2,354,179 | 7/1944 | Blanc | 123/568 |
| 2,652,040 | 9/1953 | Tritt | 123/568 |
| 3,446,196 | 5/1969 | Daigh | 123/568 |
| 3,507,260 | 4/1970 | Walker | 123/568 |
| 4,117,813 | 10/1978 | Yamashita et al. | 123/568 X |
| 4,201,180 | 5/1980 | Iizuka | 123/198 F |
| 4,221,203 | 9/1980 | Hayashi et al. | 123/568 |
| 4,237,826 | 12/1980 | Motosugi et al. | 123/25 R |
| 4,261,316 | 4/1981 | Motosugi et al. | 123/568 |
| 4,276,865 | 7/1981 | Hamal | 123/569 |
| 4,351,298 | 9/1982 | Franke | 123/568 X |

*Primary Examiner*—Willis R. Wolfe, Jr.

*Attorney, Agent, or Firm*—Robert E. McCollum; Clifford L. Sadler

[57] ABSTRACT

A self contained EGR system consists of a spacer insertable between the intake manifold and the cylinder head of an automotive type engine, the spacer including air/-gas flow passages each aligned with an intake manifold runner and a cylinder head intake port, and a corresponding number of EGR gas distribution passages at least partially surrounding each air/gas flow passage with controlled size inlet ports between the two passages for passage of EGR gases into the intake ports, and an EGR valve to control the flow of EGR gases, the valve being mounted on the spaces.

11 Claims, 4 Drawing Figures

EGR CONTROL SYSTEM

This invention relates in general to an exhaust gas recirculation (EGR) system for an automotive type engine. More particularly, it relates to one that is essentially self-contained and insertable like a cartridge between the engine intake manifold and the face of the cylinder head, making it quite attractive for retrofit and/or replacement purposes.

The invention is directed to a self-contained EGR unit that contains a number of laterally spaced air/gas intake passages corresponding in number to the number of cylinder head intake ports of the engine to which it is attached, the passages being at least partially surrounded by EGR gas distribution passages individually connected to the exhaust gases in an EGR passage controlled by a reciprocating EGR valve, communication between the distribution passages and intake flow passages being established by a number of outlet ports between the two of controlled size providing equal volume distribution of EGR gases to each of the engine cylinder intake ports.

Prior constructions usually introduced EGR gases into the intake manifold at a location just below the throttle valve and distant from the cylinder head. In this invention, the EGR gases are introduced to the cylinder head essentially at the cylinder head face. Therefore, the usual time delay between passage of the gases from the EGR control valve through the long intake manifold runners to the combustion chamber is not present. This makes control of the flow of the EGR gases much more accurate, and reduces exhaust emissions. The design also provides for good distribution of EGR between all of the engine cylinders. Good engine operation, therefore, is obtained while concurrently controlling the $NO_x$ emission limits.

EGR systems are known in which flow of EGR gases is made to more than a single engine cylinder combustion chamber. For example, U.S. Pat. No. 4,237,826, Motosugi et al, shows in FIG. 10 an EGR line 33 connected to an EGR valve 35 past a one-way check valve 32 for the flow of EGR gases into a plenum type line 18 for distribution to each of the engine cylinders.

U.S. Pat. No. 4,261,316, Motosugi et al, also shows a similar construction in providing a common EGR passage 29 leading to each of the engine cylinder combustion chambers and supplied with EGR gas from the exhaust manifold 36 as controlled by an EGR valve 35.

However, neither of the above systems are self-contained units insertable between the intake manifold and cylinder head face since the EGR passages are cast integral with the engine, and the outlets are not into the intake ports of the engine, but directly into the combustion chamber.

U.S. Pat. No. 4,276,865, Hamai, shows in FIG. 3 EGR gases being supplied individually to each of the engine cylinder combustion chambers. However, again the EGR system is not a self-contained one, and there is a time delay between the opening of the EGR valve 31 and the application of EGR gases to the combustion chamber which will affect engine operation.

U.S. Pat. No. 4,221,203, Hayashi et al, shows an EGR system in FIG. 1 similar to that described above in that there is a time delay between the application of EGR gases past an EGR valve 42 to the engine combustion chambers, and the EGR system is not self-contained.

U.S. Pat. No. 4,201,180, Iizuka, shows in FIG. 5 an EGR system in which the EGR valve is mounted close to the engine cylinder head; however, a plenum distributing EGR gases to all of the engine cylinders in the group does not direct the EGR gases specifically and individually to each of the cylinders to provide equal distribution for better engine operation. Also, the unit is not a selfcontained spacer unit that is easily insertable between the engine intake manifold and cylinder head face, but is actually cast as part of the engine.

It is, therefore, a primary object of the invention to provide a self-contained EGR system that easily can be insertable between the intake manifold and cylinder head face of an automotive type engine, essentially without modification, the spacer containing individual intake air/gas flow passages surrounded at least in part by EGR gas distribution passages connected to an EGR valve in a manner to provide equal distribution of the EGR gases to each of the individual engine cylinders, the spacer mounting the EGR system as close as possible to the engine combustion chambers to thereby minimize the time delay of flow of gases past the point of release to the point of entry into the combustion chamber.

Other objects, features and advantages of the invention will become more apparent upon reference to the succeeding detailed description thereof, and to the drawings illustrating the preferred embodiments thereof, wherein.

Figure 1:
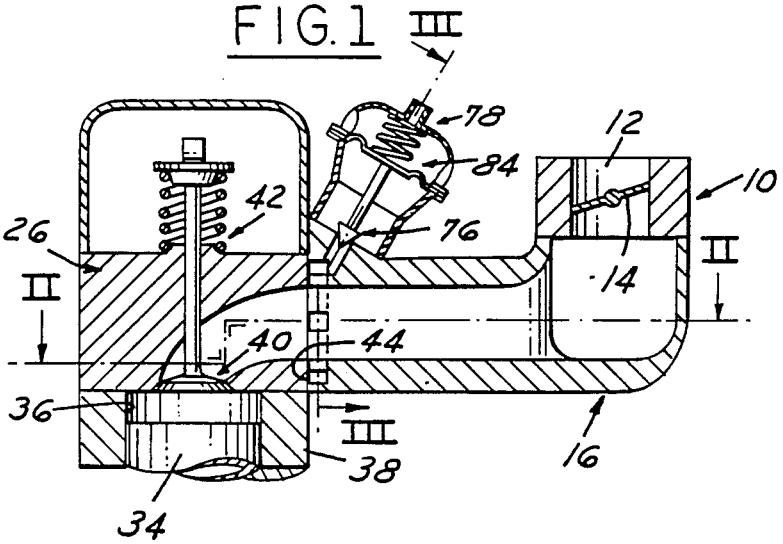
FIG. 1 illustrates schematically a crosssectional view of a portion of an internal combustion engine embodying the invention.

FIG. 1 shows a portion of an internal combustion engine that includes an air throttle body 10 having an induction passage 12 in which is mounted a rotatable throttle valve 14 in a known manner. The throttle body in this case would be connected to the clean air side of an engine air cleaner assembly (not shown) for the passage of air essentially at atmospheric pressure through the induction passage 12.

The throttle body 10 is adapted to overlie and be connected to the upper part of an engine intake manifold 16, which, in this case, contains four individual tuned runners 18 of essentially the same length defined by intermediate partitions 20.

The downstream ends of each runner 18 are connected in this case through a spacer 22, to be described, to an individual engine intake port 24 in the face of the engine cylinder head 26. The ports then connect through intake passages 28 to intake valve ports 29 opening into a combustion chamber 30. The cylinder head also includes an exhaust valve port 32, a piston 34 reciprocably mounted in the bore 36 of a cylinder block 38, and the usual reciprocating intake and exhaust valves 40 (only one shown) biased closed by a spring keeper mechanism 42.

Figure 2:
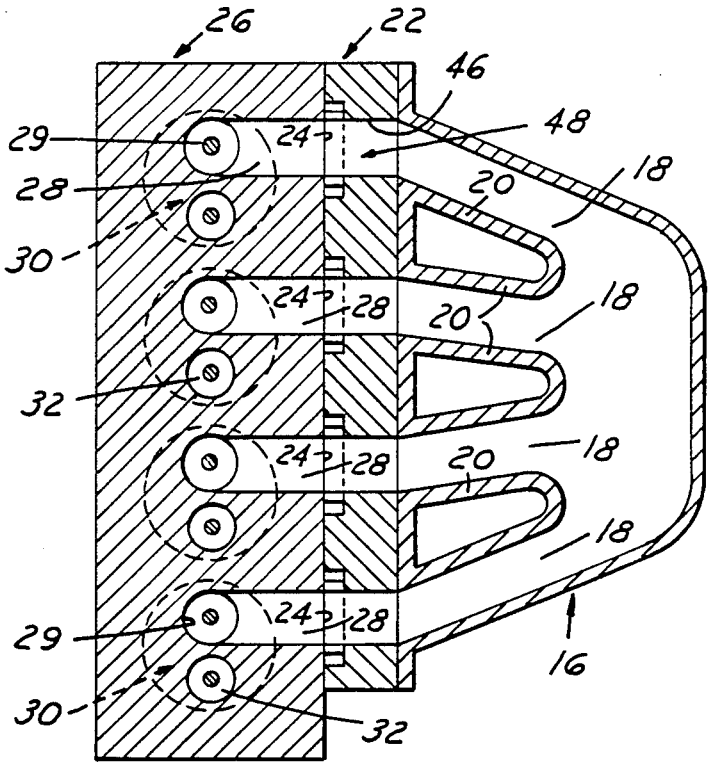
FIG. 2 is a cross-sectional view taken on a plane indicated by and viewed in the direction of the arrows II—II of FIG. 1.
Figure 3:
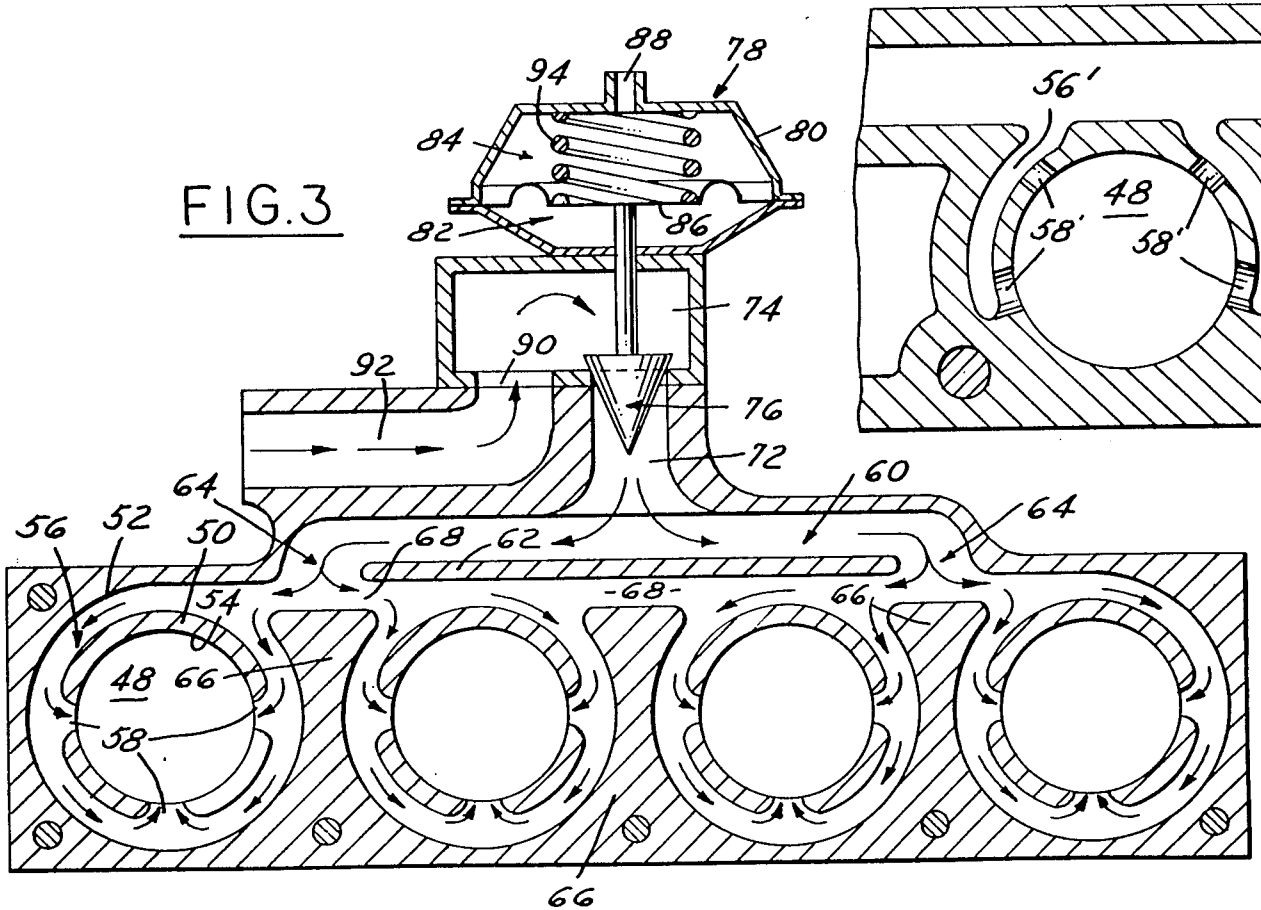
FIG. 3 is a cross-sectional view on an enlarged scale taken on a plane indicated by and viewed in the direction of the arrows III—III of FIG. 1.

Turning now to the invention, the exhaust gas recirculation (EGR) system to be used with this engine is essentially totally self-contained as a spacer unit 22 easily insertable between the end of the intake manifold 16 and the adjacent face 44 of the cylinder head. More specifically, the spacer 22 extends laterally a distance spanning all of the engine cylinders, as best seen in FIG. 2. It has a first bore 46 constituting an air/gas flow passage 48 for passage of the air/gas from throttle body 10 into each individual intake passage 28. As best seen in FIG. 3, the end of the air/gas flow passage 48 adjacent the cylinder head defines a sleeve portion 50 located within and spaced from an annular outer wall portion 52. The tubular like chamber 56 between inner and outer walls 52 and 50 constitute the EGR flow distribution passages 56 surrounding each of the intake passages 48. The sleeve portion 50 is provided with spaced openings 58 of a controlled size to permit communication of the EGR gases in passages 56 to the air/gas intake flow passages 48 and therefrom to the engine combustion chambers.

The spacer 22 is cast with a longitudinal or laterally extending plenum 60 partially defined and closed by a baffle or partition 62 defining outlet passages 64 at opposite ends. Each of the outlets is located essentially equi-distant between a pair of the EGR distribution passages 56 so as together with dividing partitions 66 provide flow openings 68 of a diameter essentially equal at all places to provide equal distribution of the flow of EGR gases to each of the engine cylinders.

The plenum 60 has an inlet 72 for EGR gases from a chamber 74 formed on the top of the spacer, the flow through which is controlled by an axially movable EGR valve 76. A vacuum servo 78 opens valve 76. It consists of a hollow housing 80 partitioned into an atmospheric air chamber 82 and a vacuum chamber 84 by an annular flexible diaphragm member 86 secured to the stem of valve 76. A vacuum tap 88 leads to a suitable source of engine vacuum, such as, for example, that which would be provided at a point just above the closed position of throttle valve 14.

The chamber 74 itself has an inlet 90 from an EGR passage 92 connected at its opposite end to a source of exhaust gases, which in most cases would be a tap from the exhaust manifold of the engine.

It will be clear, therefore, that application of vacuum through tap 88 to the servo 78 during engine running operation will raise the EGR valve 76 against the force of a return spring 94 to permit the flow of EGR gases in passage 92 to the inlet 72 to plenum 60 and therefrom to be distributed equally to the various engine cylinder intake passages 28 through the controlled outlets 58 indicated.

Figure 4:
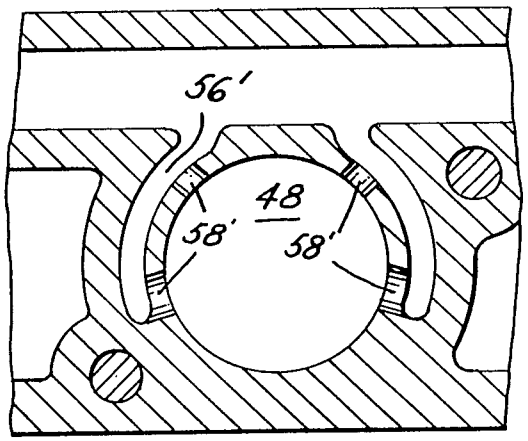
FIG. 4 is a modification of a detail illustrated in FIG. 3.

FIG. 4 shows a modified version of the FIG. 3 construction wherein the EGR distribution passages 56′ are essentially crescent shaped or semicircular in cross-section instead of as shown in FIG. 3. The spacer 22 in this case is formed to permit the use of more openings 58′ from the EGR distribution passages 56′ to the gas flow passages 48. In all other respects, however, the construction and operation is essentially the same as that previously described in connection with the FIG. 1–3 embodiment.

From the foregoing, it will be seen that the invention provides a unified EGR system that easily can be assembled to many existing engines without modification merely by separating the intake manifold from the cylinder head face and insertion of the spacer containing the EGR system. It will be clear that this readily permits the retrofit of such a system of older engines. It will also be seen that with such a construction, the EGR gases are introduced directly at the cylinder head face, and thus minimizes the delay time of the regulated EGR rate to reach the combustion chamber. Also, the particular design described provides for good distribution of EGR between all of the cylinders.

While the invention has been shown and described in its preferred embodiments, it will be clear to those skilled in the arts to which it pertains that many changes and modifications may be made thereto without departing from the scope of the invention.

I claim:

1. A self-contained exhaust gas recirculation (EGR) system for insertion as a unit between the cylinder head and the intake manifold of an internal combustion engine having an intake manifold formed with a plurality of laterally spaced individually runners connected individually from a throttle body to separate intake ports in the face of the engine cylinder head for the supply of an air/gas flow therethrough separately to each intake port, comprising an elongated spacer between the ends of the runners and the face of the cylinder head, the spacer having formed therein a plurality of laterally spaced individual air/gas flow passages each aligned with (each) one of the runners and (the) an engine intake port(s), the spacer having an EGR passage connected (at one end) to a source of exhaust gases, a plurality of EGR gas distribution passages formed within the spacer connected at one end in common to the EGR passage and at their other end communicating individually with (to) each of the spacer air/gas flow passages for the flow of exhaust gases thereinto and therefrom individually to the engine intake ports, and an EGR valve reciprocably mounted in the EGR passage on the spacer for controlling the flow of EGR gases to each intake port in approximately equal volumes.

2. An EGR system as in claim 1, wherein each of the distribution passages has limited volume outlets connected to the respective intake port associated therewith sized to provide essentially equal volume distribution of EGR gases to each cylinder.

3. An EGR system as in claim 1, wherein the spacer is a one-piece unit including a number of parallel air/gas flow passages, an equal number of EGR air/gas distribution passages surrounding at least a portion of and defining the gas flow passages, a controlled number of sized ports between the air/gas and distribution passages therein restricting communication of EGR gases from the distribution passages to the air/gas flow passages, a laterally extending passage interconnecting all of the EGR distribution passages, the spacer further having partition means defining a laterally extending plenum spanning the air/gas flow passages and having an outlet at each end for discharging EGR gases into the distribution passages, the spacer further having formed therein the EGR passage connected at one end to the source of EGR gases and its other end to an inlet to the plenum, the EGR valve being mounted on the spacer for movement into and out of the EGR passage adjacent the inlet to the plenum.

4. An EGR system as in claim 1, the connection of the exhaust gas distribution passages to the EGR passage including a plenum having an inlet connected to the EGR passage downstream of the EGR valve and a number of equal controlled sized outlets connecting the exhaust gases to each of the distribution passages in essentially equal volumes.

5. An EGR system as in claim 4, including a tubular-like wall member partially surrounding and defining each spacer gas flow passage and also defining the gas distribution passage.

6. An EGR system as in claim 4, wherein each of the distribution and air/gas pasasges is defined by a sleeve spaced from an outer annular wall defining an outer annular flow passage between the two walls and an inner passage within the sleeve, and a controlled number of openings through the sleeve controlling the communication of the exhaust gases from the distribution pasage to the air/gas flow passage.

7. An EGR system as in claim 6, wherein the distribution passages are of approximately equal length from the plenum to provide approximately equal distribution of EGR gases to each of the engine cylinders.

8. An EGR system as in claim 4, wherein the EGR valve is mounted on the spacer above the air/gas flow pasasges and close to the cylinder head face to minimize the length of the air/gas flow passages.

9. An EGR system as in claim 8, wherein the engine includes four in-line cylinders, the spacer including a corresponding number of air/gas flow passages and EGR distribution passages, and passage means of limited volume interconnecting all of the EGR distribution passages.

10. An EGR system as in claim 9, wherein the number of plenum outlets discharges EGR gases into the passage means of limited volume at a location between pairs of distribution passages.

11. An EGR system as in claim 10, wherein the plenum is annular and has an outlet at opposite ends each of a size essentially the diameter of the plenum and the EGR distribution passages.

* * * * *